United States Patent [19]

Oshima et al.

[11] 4,345,555

[45] Aug. 24, 1982

[54] SELF-HEATING IGNITION PLUG

[75] Inventors: Yujiro Oshima; Yoshiyasu Fujitani; Hideaki Muraki; Shiroh Kondoh; Kouji Yokota, all of Nagoya, Japan

[73] Assignee: Kabushiki Kaisha Toyota Chuo Kenkyusho, Nagoya, Japan

[21] Appl. No.: 130,589

[22] Filed: Mar. 14, 1980

[30] Foreign Application Priority Data

Mar. 20, 1979 [JP] Japan ..... 54-32870

[51] Int. Cl.[3] ..... F02P 19/00; F02P 23/02

[52] U.S. Cl. ..... 123/272; 123/145 R; 123/145 A; 123/179 H; 219/270; 361/266; 431/262; 431/268

[58] Field of Search ..... 123/143 R, 143 B, 145 A, 123/145 R, 272, 276, 254, 255, 179 H; 219/270; 361/266, 264; 431/262, 268; 60/39.82 C

[56] References Cited

U.S. PATENT DOCUMENTS

| | | | |
|---|---|---|---|
| 2,130,365 | 9/1938 | Paulson | 123/145 A |
| 3,191,659 | 6/1965 | Weiss | 431/268 X |
| 3,243,631 | 3/1966 | Clark | 60/39.82 C |
| 3,481,317 | 12/1969 | Hughes et al. | 123/272 X |
| 4,061,122 | 12/1977 | Edgar et al. | 123/143 R X |

*Primary Examiner*—Tony M. Argenbright

*Attorney, Agent, or Firm*—Berman, Aisenberg & Platt

[57] ABSTRACT

A self-heating type ignition plug according to the present invention includes a base portion having a fixing portion formed on an outer wall thereof and a terminal insulately provided therein and connected to an electrical source; an ignition means, integrally connected to the base portion, having an ignition surface formed on a wall surface thereof and composed of a catalyst comprising a transition material, thereby to come in contact with the fuel; and a heating means having a resistive exothermic element connected to the terminal of the base portion, the resistive exothermic element being provided adjacent to the ignition surface within the ignition means, whereby the fuel may be ignited and burned as a whole by the ignition surface of the catalyst which is maintained to a preset temperature due to the oxidation reaction of the catalyst and the fuel being in contact therewith after the heating means is deenergized.

38 Claims, 17 Drawing Figures

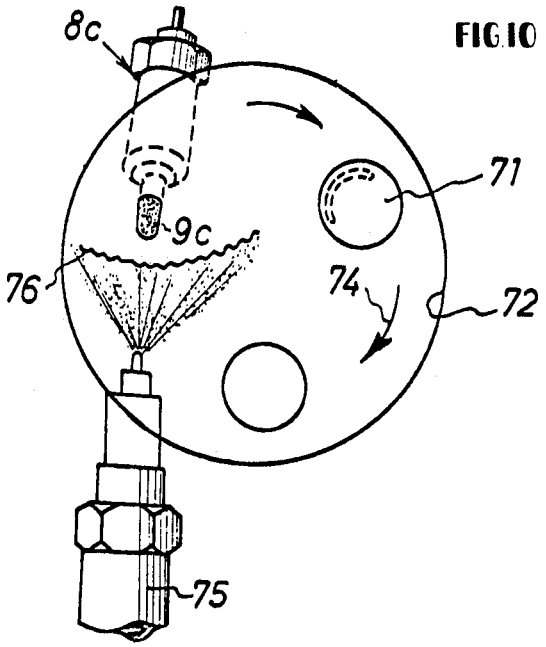
FIG. 10
FIG. 13
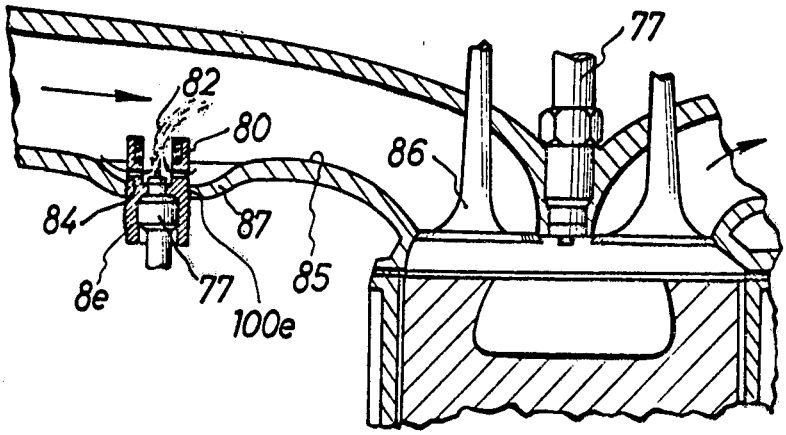

SELF-HEATING IGNITION PLUG

BACKGROUND

The present invention relates to a self-heating type ignition plug (SHIP) which can be widely used, and more particularly to an ignition plug of a type in which multiplication of electric heating and self-heating actions is effected to improve thermal efficiency to reduce power consumption, in which fuel is evaporated and ignited as soon as possible to ensure stable and smooth combustion and in which construction is simplified to improve productivity and durability while reducing production cost.

According to prior art, in a compression ignition engine, such as a Diesel engine, fuel is fed under high pressure in an atomized state into a combustion chamber in an engine cylinder so that the atomized fuel may be brought into contact with highly-compressed hot air, thereby effecting its spontaneous combustion. However, when the temperature of ambient air is low, intake air cannot be heated to a sufficiently high level even after it has been compressed, thus making it difficult to ensure combustion and to start the engine. In order to facilitate ignition of fuel, therefore, the engine combustion chamber is equipped with a heating plug, which is heated with electric power, and an auxiliary ignition plug which is called a glow plug. The heating plug of this type is a kind of an electric heating plug and is divided into a type in which an exothermic element of electric resistance type is exposed directly to the outside and into a type in which the exothermic element is covered through an insulating substance with a protecting metal. The surface temperature is raised to 800 to 1000° K. by a power supply. The heating plug of this conventional type is energized prior to starting the engine, thus preheating air in the combustion chamber at the end of the compression stroke and promoting ignition of atomized fuel by the hot inner wall of the combustion chamber due to the preceding combustion. However, a multi-cylinder engine is equipped with a corresponding number of conventional heating plugs, each requiring a current of 10 amperes during the heating operation. Therefore, continuous use of the heating plugs is limited by the capacity of the battery to a period of from 30 to 120 seconds. Immediately after the engine starts, moreover, the temperature of the inner wall of the combustion chamber is so low as to establish a remarkably long ignition delay from the injection and to the ignition of the fuel. More specifically, an engine which is equipped with a conventional heating plug and which has been used in experiments conducted by the Inventors produces such an abnormal combustion cycle [which is indicated at solid curve A in FIG. 1 plotting the temperature (°K.) of the combustion gases against the crank angle] that ignition (IG) is experienced far after the top dead center (TDC) and immediately before the bottom dead center (BDC), while generating high noises. Incidentally, broken curve B in FIG. 1 indicates the normal combustion cycle. In the preceding abnormal combustion cycle the engine cannot generate its expected output but, still the worse, discharges white smoke due to unburned fuel as a result of incomplete combustion. The condition thus far described is continued for several or more minutes after the engine starts before the wall temperature of the combustion chamber is heated up. From the experiments conducted by the Inventors with the use of a conventional heating plug, moreover, it has also been revealed that the surface temperature of the heating plug after the engine starts has such a tendency as is indicated in solid line C in FIG. 2, in which the surface temperature of the heating plug is plotted on the ordinate against the running time (in minutes) of the idling from the engine start plotted on the abscissa so that the variation in the surface temperature of the heating plug may be illustrated. In FIG. 2, the period of power supplying time is indicated in a character PS. As shown, if the power supply to the heating plug is interrupted, the surface temperature thereof is abruptly dropped, but is gradually elevated, as the combustion in the combustion chamber reaches the normal condition, until it is stabilized about 14 minutes later. This time becomes more or less different in accordance with the running conditions of the engine, cooling water temperature or ambient temperature. It is also confirmed by the experiments of the Inventors that white smoke is discharged from the engine when the surface temperature of the heating plug is lower than 800° K. In this respect, another experiment has been conducted by continuously supplying the heating plug with the electric power for about ten minutes or more, although this long a power supply is practically impossible due to the limited capacity of the battery. It has also been confirmed from the experiment that neither the white smoke nor the combustion cycle shown in FIG. 1 are sustained. In FIG. 2, the period of generating time of the white smoke is shown in a character WS.

Therefore, it has been desired that a heating plug of remarkably low power consumption be developed for practical use.

On the other hand, the conventional heating plug is so constructed that a protecting metal tube is heated through an insulating substance by a resistive exothermic element disposed therein. In order to hold the protecting metal tube at a necessary temperature, consequently, the exothermic substance itself has to be held at a considerably high temperature, requiring a substance having a high melting point. As a material satisfying the required condition, various kinds of substances have been developed, each has a low resistivity so that it has to be machined into a wire having a practical resistance and a preset exothermic capacity. A conventional heating plug has the following drawbacks: its construction is so complicated that its productivity is hampered and it is unduly susceptible to accidental breakage of the wire.

THE PRESENT INVENTION

The present invention contemplates elimination of the foregoing problems and has an object to provide a self-heating type ignition device which comprises a resistive exothermic element for liberating heat, when energized, and a catalyst arranged in the vicinity of said resistive exothermic element and made of at least one or any combination of platinum, rhodium and palladium for effecting oxidation reaction with the fuel which comes into contact therewith, thereby liberating heat.

A primary object of the present invention is to provide a self-heating type ignition plug (SHIP) which comprises an ignition means having an ignition surface to be in contact with fuel, composed of a catalyst comprising a transition material, and heating means, such as a resistive exothermic element, provided adjacent to the ignition surface.

Another object of the present invention is to provide a self-heating type ignition plug which ignites and burns as a whole by the ignition surface composed of a catalyst maintained to a preset temperature due to oxidation reaction of the catalyst and fuel being in contact therewith, after the heating means is deenergized.

Still another object of the present invention is to provide a self-heating type ignition plug which restrains generation of white smoke thereby to reduce noxious contents in engine exhaust gases together with the fuel consumption rate.

Yet another object of the present invention is to provide a self-heating type ignition plug which can attain the practically significant effects that it effects the multiplication of the electric or ohmic heating and self-heating action so that the thermal efficiency may be remarkably improved while sparing power consumption.

A further object of the present invention is to provide a self-heating type ignition plug in which fuel is evaporated and ignited as soon as possible so that it may be stably and smoothly burned.

A still further object of the present invention is to provide a self-heating type ignition plug of which the construction is simplified to enhance productivity and durability while reducing production cost.

A further object of the present invention is to provide a self-heating type ignition plug which prevents noises resulting from ignition delay due to prompt ignition.

A further object of the present invention is to provide a self-heating type ignition plug which also provides a self-cleaning action for burning out soot adhered to an ignition plug by the active oxidation.

A further object of the present invention is to provide a self-heating type ignition plug which is applicable to many types of engines and devices, in which it is exposed to fuel.

Still further objects are apparent from the description which follows.

BRIEF DESCRIPTION OF THE DRAWINGS

FIGS. 9 and 10 are partially sectional views respectively showing the ignition plug according to the fourth embodiment of the present invention and the application example thereof.

FIGS. 12 and 13 are partially sectional views respectively showing the sixth embodiment of the present invention.

DETAILS

Figure 1:
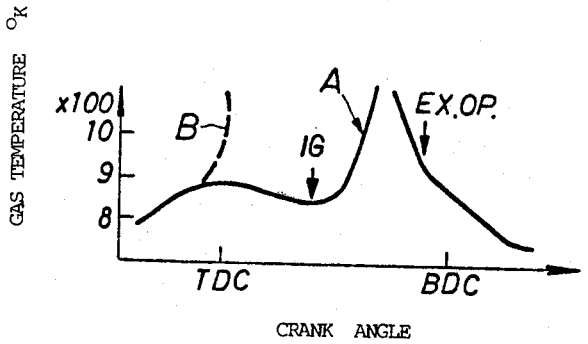
FIG. 1 is a graphical presentation showing the combustion cycle of an engine equipped with a conventional ignition plug.

A self-heating type ignition plug (SHIP) according to the present invention comprises a base portion having a fixing portion formed on an outer wall thereof and a terminal insulately provided therein and connected to an electrical source; an ignition means, integrally connected to said base portion, having an ignition surface formed on a wall surface thereof and composed of a catalyst comprising a transition metal, thereby to come in contact with the fuel; and a heating means comprising a resistive exothermic element connected to the terminal of the base portion, the resistive exothermic element being provided adjacent to the ignition surface within the ignition means, whereby the fuel may be ignited and burned as a whole by the ignition surface of the catalyst which is maintained to a preset temperature due to the oxidation reaction of the catalyst and the fuel being in contact therewith after the heating means is deenergized. Thus, the self-heating type ignition plug can attain the practically significant effects that it effects the multiplication of the electric or ohmic heating and self-heating actions so that the thermal efficiency may be remarkably improved while sparing power consumption, that the fuel is evaporated and ignited as soon as possible so that it may be stably and smoothly burned, and that the construction is simplified to enhance the productivity and durability while reducing production cost.

If, on the other hand, the self-heating type ignition device of the present invention is applied to a compression ignition internal combustion engine, such as a Diesel engine, the ignition is effected promptly by the aforementioned electric or ohmic heating and self-heating actions so that the noises, which might otherwise result from the ignition delay, can be prevented. Moreover, the stable and smooth combustion is effected to restrain generation of white smoke, thus reducing the noxious content of engine exhaust gases together with fuel consumption. Still moreover, a self-cleaning action for burning out the soot adhered to the ignition plug can be effected by active oxidation. On the other hand, the ignition plug of the present invention can find its most proper applications, if it is exposed to fuel, as an ignition plug for a constant combustion system, such as a preheating chamber, an internal combustion engine with a vortex chamber, an internal combustion engine of injection type into a cylinder or intake pipe, a gas turbine, boiler or a heating furnace, as an ignition device for a heater, or as a preheater for the intake air.

The present invention includes the following first to fourth aspects.

In a self-heating type ignition type plug (SHIP) according to a first aspect of the present invention, the ignition means comprises a rod member and the ignition surface is formed on an outer wall of the rod member.

In a self-heating type ignition plug according to the second aspect of the present invention, the ignition means comprises a hollow member and the ignition surface is formed on an inner wall of the hollow member.

In a self-heating type ignition plug according to a third aspect of the present invention, the ignition means comprises a hollow member and the ignition surface is formed on an outer wall of the hollow member.

In a self-heating type ignition plug according to a fourth aspect of the present invention, the ignition means comprises a hollow member and the ignition surface is formed on an inner wall of the hollow member and is further formed on an outer wall thereof.

A catalyst in the present invention should be at least one which effects an oxidation reaction by being made in contact with fuel to liberate heat. Such a catalyst comprises a porous carrier and at least one of the transition metals supported on a porous carrier. The porous carrier is selected from the group consisting of magnesia, silicagel, titania, zirconia, mullite, silicon nitride, sordierite, alumina-magnesia spinel, alumina-cobalt spinel, and ferrite of spinel structure. The transition metal of the catalyst means is made of at least one metal selected from the group of platinum, rhodium, palladium, nickel, iron, cobalt, chromium, tungsten, molbydenum, vanadium, mixtures thereof and oxides thereof.

Figure 3:
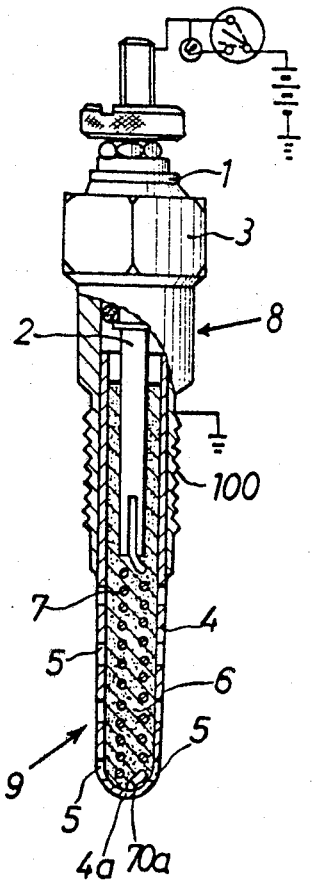
FIGS. 3 and 4 are partially sectional views respectively showing the ignition plug according to the first embodiment of the present invention and the application example thereof.
Figure 4:
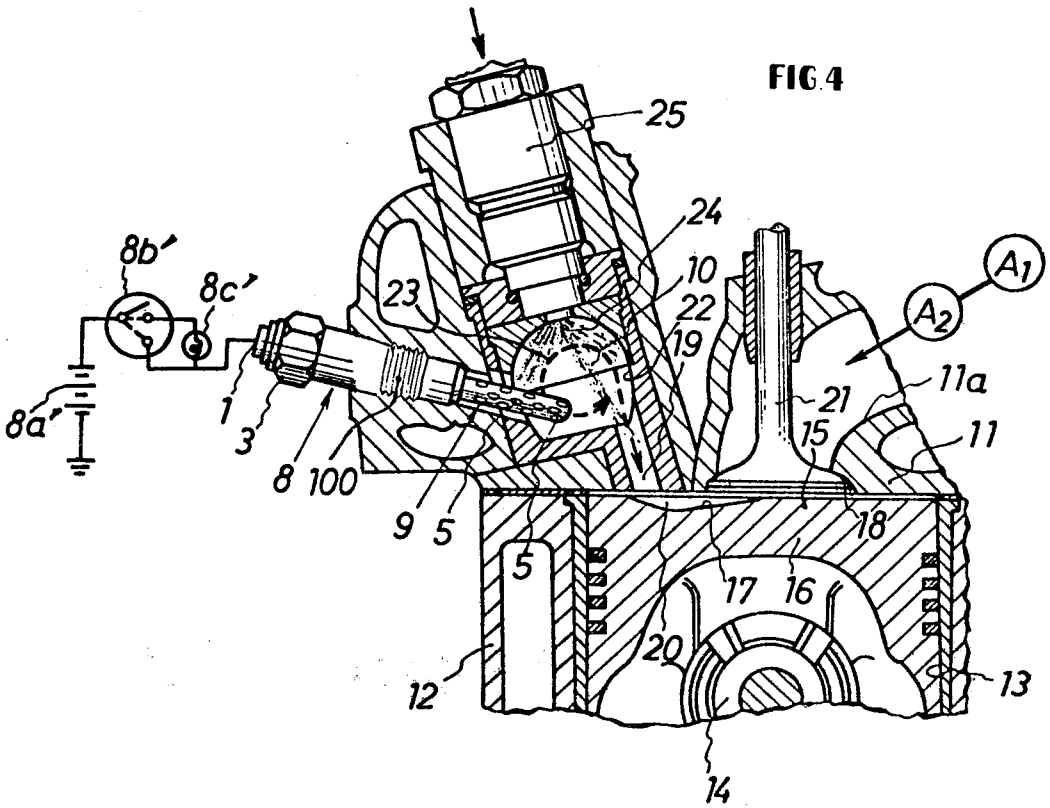

The present invention will be described in detail in the following in connection with the embodiments thereof. Referring first to FIGS. 3 and 4 showing a self-heating type ignition plug (SHIP) 8 according to a first embodiment of the present invention, a protecting metal tube 4 having a bottomed tubular shape is fixed integrally to an attachment portion 3 which has its center portion insulated by means of an insulator 1 while holding a positive terminal 2. The protecting metal tube 4, thus fixed, has its circumferential wall formed with a plurality of communication holes 5 which extend therethrough. In the protecting metal tube 4, moreover, there is arranged a catalyst 6 which is made of at least one or any combination of the transition metals and which is operative to effect the oxidation reaction of the catalyst and the fuel which comes into contact therewith, to liberate heat. The catalyst 6 comprises a carrier composed of a porous body of alumina-magnesia spinel and platinum as a transition metal supported on the porous carrier. The catalyst 6 was prepared as follows:

Alumina powder of 74 wt. % having a mean particle diameter of 0.1 micron and magnesia powder of 26 wt. % having a mean particle diameter of 0.3 micron were mixed with each other, and further a small amount of water was added to the mixture. And then the mixture was heated at 1350° C. for 10 hours in an electric furnace to sinter the same. Thus, alumina-magnesia spinel powder was obtained. A metal die having a cavity of cylindrical shape with a bottomed portion was prepared, and then a coil heater was interposed within the cavity. The above-mentioned spinel powder was charged into the cavity and heated to sinter the alumina-magnesia spinel powder and to obtain a sintered porous body of the spinel. Then the sintered porous body of the spinel provided with the coil shaped heater therein was removed from the cavity of the metal die. The sintered porous body was immersed in a solution of platinum nitrate, removed therefrom, and then dried and heated.

Thus, the resulting sintered porous body as a catalyst was prepared, which was provided with the coil shaped heater therein and which was impregnated with platinum as one component of the catalyst. The thus-prepared body for a catalyst was inserted into a metal tube 4 and then attached to the base portion of an ignition plug, thereby forming an ignition plug 8 according to the first embodiment of the present invention.

In the catalyst 6, there is coaxially arranged a resistive exothermic element 7 having a coil shape, which is connected highly conductively with the aforementioned positive terminal 2 so that it can liberate heat when it is energized. The resistive exothermic element 7 and the protecting metal tube 4 are properly insulated from each other by the insulating function of the aforementioned catalyst 6. The opposite end portion 70*a* of the resistive exothermic element 7 to the positive terminal 2 of the same is grounded to the aforementioned protecting metal tube 4 at the bottom portion 4*a* thereof. Thus, the ignition plug 8 according to the first embodiment has its protecting metal tube 4 and catalyst 6 constituting an igniting portion 9. In FIG. 3, a character 100 shows a screw part of an attachment portion 3 in the base portion for attaching the ignition plug to a predetermined portion of a combustion chamber in an engine.

Before entering into the description of the operational effects of the example, in which the ignition plug of the first embodiment having the aforementioned construction is applied to an internal combustion engine with a vortex flow chamber, the construction of the internal combustion engine with the vortex flow chamber will be described with reference to FIG. 4.

The engine body comprises a cylinder head 11 and a cylinder block 12, and a combustion chamber comprises a first or primary combustion chamber 10 and a second or secondary combustion chamber 20. The cylinder block 12 is formed with a cylinder 13, within which a piston 16 is reciprocally movably arranged and is made coactive with a not-shown crankshaft through a connecting rod 14. The piston 16 has its upper portion 15 formed with a recess 17 so that the secondary combustion chamber 20, having a smaller volume, may be formed between the cylinder 13 and the cylinder head 11. As seen from FIG. 4, the recess 17 is made deepest at a portion facing a later-described communication passage 19 and gradually shallower and shallower toward the circumferential edge thereof. The cylinder head 11 is formed with both an intake port 18 for communicating with an intake passage 11*a* and an exhaust port for communicating with an exhaust passage (both of which are not shown). The intake port 18 and the exhaust port are opened to have communication with the secondary combustion chamber 20. In the intake port and the exhaust port, respectively, there are arranged an intake valve 21 and an exhaust valve such that they are opened and closed in preset timings in synchronism with the rotations of the engine. The intake passage 11*a* is used to supply the intake air from the air cleaner $A_1$ through an air valve $A_2$ to the aforementioned secondary combustion chamber 20. On the other hand, the cylinder head 11 is formed above the aforementioned secondary combustion chamber 20 with the primary combustion chamber 10 having a larger volume, which is made to have communication with the secondary combustion chamber 20 through the communication passage 19. This communication passage 19 has its axis extending tangentially along the inner wall 22 of the primary combustion chamber 10. Thus, the air introduced into the secondary combustion chamber 20 is further introduced tangentially of the communication passage 19 into the primary combustion chamber 10 so that a vortex flow 23 having a swirling velocity or a high intensity is generated in the primary combustion chamber 10, as seen from FIG. 4.

The fuel supply means for the internal combustion engine with the vortex flow chamber as the first combustion chamber, to which the ignition device according to the first embodiment is applied, is constructed to include a fuel injection valve 25 having its injection port 24 opened into the primary combustion chamber 10, an air flow meter for detecting the flow rate of the intake air flowing through the intake passage 11*a*, a tachometer for detecting the revolutions of the engine, a control unit made responsive to the signals of the aforementioned flow rate of the intake air and the revolutions of the engine to generate signals for controlling the injection rate of a fuel, such as gasoline, in accordance with the running conditions of the engine while taking the temperature of the engine cooling water into consideration, and a fuel supply device for feeding the fuel injection valve 25 with the fuel under pressure in a quantity according to control signals of said control unit. The fuel injection valve 25 may be either of a mechanical control type or of an electromagnetic or electronic control type so that it can inject a preset quantity of fuel under pressure from said fuel supply device into the primary combustion chamber 10. On the other hand, the present ignition plug 8, acting as the igniting means, is connected with a battery 8*a* through a switch 8*b* and a signal lamp 8*c* and is arranged such that its igniting portion 9 is exposed to the vortex flow 23 generated in the primary combustion chamber 10 and is positioned in the vicinity of the aforementioned fuel injection valve 25 in a manner to contact with the fuel injected therefrom.

Figure 2:
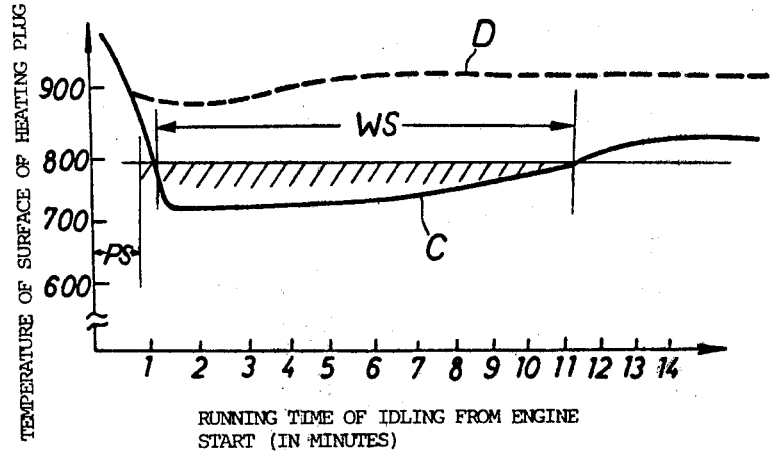
FIG. 2 is a graphical presentation showing the change in the temperature of the hot ignition plug.

When it is intended to start the internal combustion engine with the vortex flow chamber equipped with the ignition plug according to the first embodiment having the foregoing construction, the switch 8*b* is shifted to its preheat position so that the resistive exothermic element 7 of the ignition plug 8 may be energized. As a result, the resistive exothermic element 7 liberates heat to heat the catalyst layer 6 and the protecting metal tube 4. Then, the surface temperature of the catalyst 6 and the metal tube 5 reaches a high temperature of about 900° K. within a short time period, i.e., about several tens of seconds, as shown in a broken curve D in FIG. 2. In response to the hot condition of the igniting portion 9, the signal lamp 8*c* is lit. After that, the switch 8*b* is shifted to its start position so that a starter motor may be turned. As a result, the internal combustion engine with the vortex flow chamber is started so that the fuel is injected in the atomized state from the fuel injection valve 25 into the primary combustion chamber 10. The fuel thus atomized partially reaches the protecting metal tube 4 and the catalyst 6 through the communication holes 5 of the metal tube 4 so that it is instantly evaporated from and ignited by their surfaces. In the meanwhile, the fuel fed to the catalyst 6 effects its active oxidation when it contacts therewith, and it liberates a high calorie of heat to raise its maximum temperature. On the surface of the catalyst 6, the oxidation reaction is aided and promoted as long as the fuel droplets exist. With the initial ohmic heating action reaching as high as 600° K., the surface temperature of the plug 8 is maintained at a sufficiently high temperature with a high thermal efficiency, as seen from the broken curve D of FIG. 2, even if the resistive exothermic element 7 is deenergized immediately after that temperature is reached. As a result, the fuel, which is conveyed to swirl by the vortex flow spurting from the secondary combustion chamber 20 into the primary combustion chamber 10, can be ignited easily without fail by the aforementioned ignition device 8. After that, the flame jet, which has been generated as a result of the ignition and combustion in the primary combustion chamber 10, flows through the communication passage 19 into the secondary combustion chamber 20 so that the fuel in this secondary combustion chamber 20 is instantly burned out. Thus, the ignition device 8 can attain the practical effect that it can be free from any incomplete combustion, thereby preventing the generation of white smoke of unburned fuel so long as the igniting portion 9 thereof performs its self-heating action to maintain a high temperature exceeding the level of about 800° K.

Under the full load condition of the internal combustion engine with the vortex flow chamber thus far described, on the other hand, the surface temperature of the igniting portion 9 of the aforementioned ignition plug 8 reaches as high a temperature as about 1300° K. Since, however, the catalyst 6 can endure a temperature of about 1500° to 1600° K., the present internal combustion engine can attain another practical effect that it can sufficiently ensure the oxidation of the catalyst and thus to enhance to a remarkable degree the reliability and durability of the ignition plug 8 according to the present invention. Under full load conditions, moreover, since the flow rate of fuel injected from the fuel injection valve 25 is increased, the ignition plug 8 can be prevented from having its catalyst 6 abnormally overheated thanks to latent heat of evaporation as a result of contact with the increased fuel. Still, moreover, the self-heating type ignition plug 8 according to the first embodiment can attain not only the self-exothermic action by the catalyst 6 but also the effect that the temperature for the spontaneous combustion of the fuel arriving at or coming close to the surface of the igniting portion 9 is so lowered by the catalytic action of the catalyst 6 as to facilitate the start of the engine to a remarkable extent.

On the other hand, generally speaking, one of the causes for noises of a Diesel engine comes from ignition delay, i.e., the long time interval from the start of injection to ignition of fuel. This is explained to come from the fact that the fuel, which is injected but fails to be instantly ignited, will be accumulated and ignited all at once to invite an abrupt increase in pressure. The period of ignition delay is divided into two periods, i.e., the delay in chemical reaction from evaporation and the delay in the initial reaction. The sum of these two delay periods exceeds about 10 to 15 degress (in terms of the crank angle). Although the evaporation is determined by temperature, the reaction is remarkably promoted by the use of ignition plug 8 according to the first embodiment so that the ignition delay can be so shortened as to smoothen the pressure rise, thereby reducing combustion noises. Moreover, the ignition plug 8 according to the present first embodiment can attain not only self-cleaning action for completely burning out to eliminate soot, which might otherwise be generated as a result of combustion of fuel, by oxidation at igniting portion 9 thereof but also the excellent practical effects that it is excellent in corrosion and shock resistance and that it can endure heavy explosions under high pressure. Still moreover, since the power supply to the resistive exothermic element 7 can be performed within a shorter time than the prior art so that the protecting metal tube 4 and the catalyst 6 can be efficiently heated to preset temperatures, the ignition plug 8 according to the present first embodiment can attain a further effect that the power consumption can be markedly reduced. Furthermore, since the construction attaining the multiplication of the ohmic heating and self-heating actions comprises the resistive exothermic element 7 and the catalyst 6, the ignition plug 8 according to the present first embodiment can effect the practical advantages that the construction of the device itself can be simplified while enhancing the productivity and that the durability can be remarkably improved with the aid of the protecting metal tube 4 while reducing the production cost.

Figure 5:
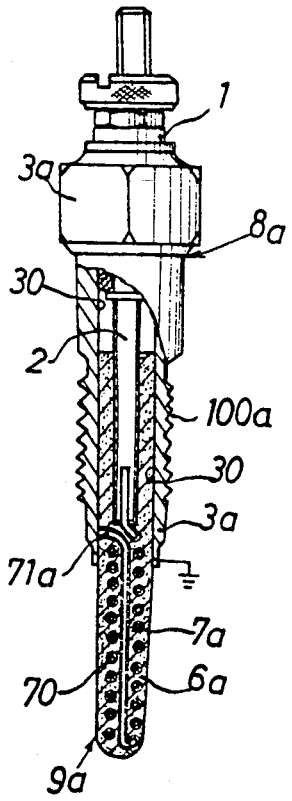
FIGS. 5 and 6 are partially sectional views respectively showing the ignition plug according to the second embodiment of the present invention and the application example thereof.
Figure 6:
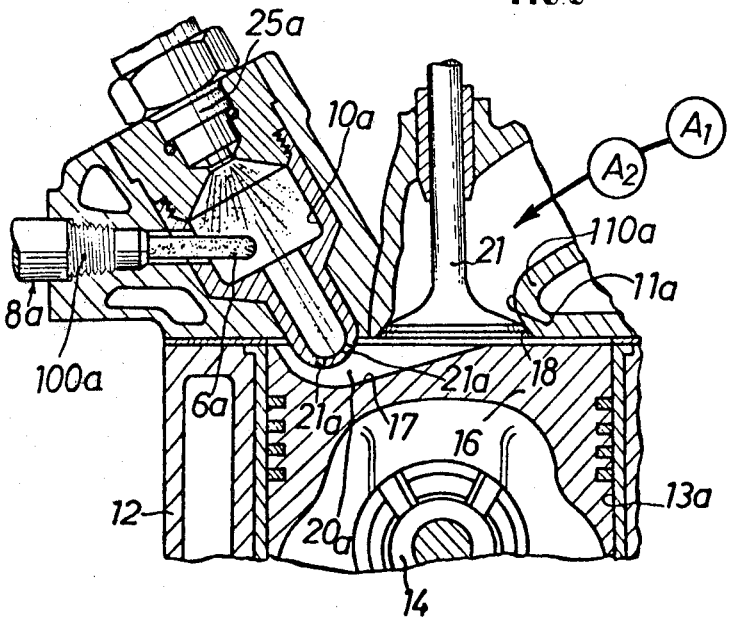

Now, the self-heating type ignition plug (SHIP) 8*a* according to the second embodiment of the present invention and the application example thereof will be described with reference to FIGS. 5 and 6, respectively. In the following embodiment, incidentally, the same parts as those in the aforementioned first embodiment are indicated at the same reference numerals, and the following description is stressed upon the differences while omitting the common parts.

The ignition plug 8*a* of the present second embodiment is made different from the foregoing first embodiment in that the protecting metal tube having the bottomed tubular shape is dispensed with and in that a resistive exothermic element 7*a* in the shape of a coil is arranged in a thin tube 70 which is made of a stainless material such as Ni-Cr alloy, Fe-Cr alloy, Fe-Cr-Al alloy or the like. More specifically, the catalyst 6*a* is made of at least one or any combination of platinum, rhodium and palladium and is operative to effect an oxidation reaction by means of contact with the fuel, thereby liberating heat. The catalyst 6*a* thus made is sintered into a rod shape having a rounded leading end at one end thereof and a present length according to the present second embodiment. The other end of the rod-shaped catalyst 6*a* is retained hermetically and integrally in the bore 30 of the attachment portion 3*a* which in turn retains the positive terminal 2 in an insulated manner. Within the rod-shaped catalyst 6*a*, there is arranged the coil-shaped resistive exothermic element 7*a*, which is highly conductively connected with the aforementioned positive terminal 2, thereby liberating heat when energized, such that it is covered highly hermetically with the thin tube 70 made of a stainless material. Thus, the resistive exothermic element 7*a* is highly hermetically isolated from the catalyst 6*a* through the aforementioned thin tube 70 thereby to ensure its corrosion resistance.

On the other hand, the opposite end portion 71*a* of the resistive exothermic element 7*a* to the positive terminal 2 is grounded to the depending edge of the aforementioned attachment portion 3*a*. As a result, the rod-shaped catalyst 6*a* of the ignition plug 8*a* according to the present second embodiment uses the resistive exothermic element 7*a* and the thin tube 70 as a kind of core so that its strength is improved while enhancing the shock or vibration resistance and durability, thus constituting the igniting portion 9*a*. In FIG. 5, a character 100*a* shows a screw part of an attachment portion 3*a* in the base portion for attaching the ignition plug to a predetermined portion of the combustion chamber in an engine.

The operational effects of the ignition plug 8*a* thus constructed according to the present second embodiment will be described for the case in which it is applied to an internal combustion engine with a precombustion chamber. The precombustion chamber serves as a first combustion chamber. In the internal combustion engine with the precombustion chamber, more specifically, the intake air is sucked into a main combustion chamber 20*a* as a second combustion chamber of a cylinder 13*a* through an intake passage 11*a*, as shown in FIG. 6. A cylinder head 110*a* is formed with a precombustion chamber 10*a* which has communication with the aforementioned main combustion chamber 20*a* through small holes 21*a*. At the bottom of the precombustion chamber 10*a*, there is disposed a fuel injection valve 25*a*, in the vicinity of which there is disposed the ignition plug 8*a* in such a manner that an igniting portion of the plug 8*a* is inserted into the precombustion chamber 10*a* by penetrating the side wall of the chamber 10*a* and the igniting portion thereof faces within the range of an injection angle of the injection valve. As a result, a portion of the fuel, which has been injected into the precombustion chamber 10*a*, is introduced through the thin holes 21*a* into the main combustion chamber 20*a*, whereas the remainder stays in the precombustion chamber 10*a*. The fuel thus left in the precombustion chamber 10*a* will arrive at and contact with the outer surface of the rod-shaped catalyst 6*a* constituting the igniting portion of the ignition plug 8*a*. Since, in this meanwhile, the ignition plug 8*a* has already been heated to a high temperature by the heat which is liberated from the resistive exothermic element 7*a* energized in advance, the aforementioned fuel is instantly evaporated and ignited. The fuel thus fed to the rod-shaped catalyst 6*a* is brought into contact with the catalyst 6*a* to establish the more active oxidation thereby liberating a high calorie of heat by itself so that the maximum temperature is accordingly raised. On the surface of the catalyst 6*a*, the reaction is aided and promoted as long as fuel droplets exist. With the initial ohmic heating action as high as 600° K., the surface temperature thereof is maintained at a sufficiently high level with a high thermal efficiency even when the resistive exothermic element 7*a* is deenergized immediately after that temperature is reached. As a result, fuel in the precombustion chamber 10*a* can be ignited easily without fail by the aforementioned ignition plug 8*a*. After that, the flame jet, which is generated as the result of the ignition and combustion in the precombustion chamber 10*a*, flows into the main combustion chamber 20*a* through the small holes 21*a* so that even the fuel in the main chamber 20*a* can be burned out as instantly as possible. Thus, the internal combustion engine with the precombustion chamber equipped with the ignition plug 8*a* according to the present second embodiment can actually attain substantially the same operational effects as those of the internal combustion engine with the vortex flow chamber according to the aforementioned first embodiment.

Figure 7:
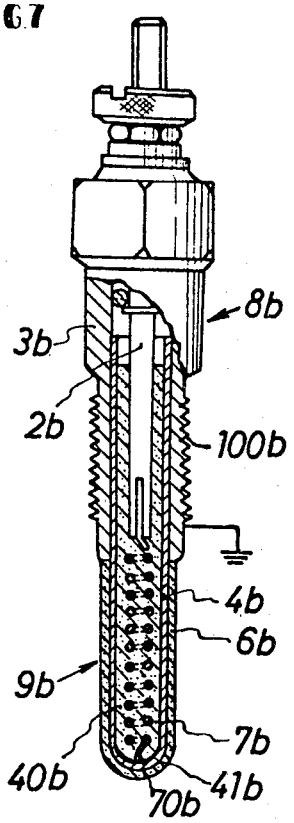
FIGS. 7 and 8 are partially sectional views respectively showing the ignition plug according to the third embodiment of the present invention and the application example thereof.
Figure 8:
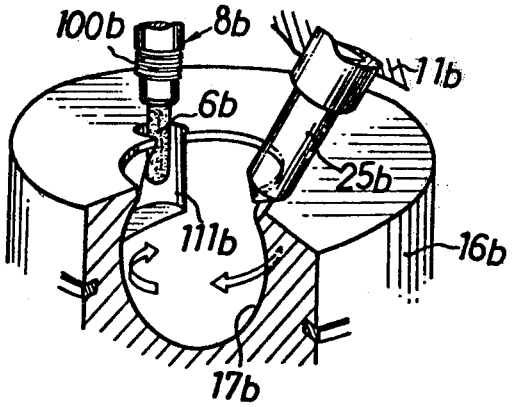

Now, the self-heating type ignition plug (SHIP) 8*b* according to the third embodiment of the present invention and an application example thereof, will be described with reference to FIGS. 7 and 8, respectively.

The ignition plug 8*b* according to the present third embodiment is different from the foregoing embodiments in that the protecting metal tube 4*b* having the bottomed tubular shape is coated with catalyst 6*b*. In the ignition plug 8*b* of the present third embodiment, more specifically, the protecting metal tube 4*b* is fixed integrally to the attachment portion 3*b* which holds the positive terminal 2*b* in an insulating manner. The protecting metal tube 4*b* has its inside filled up with an insulating substance 40*b*, such as magnesium oxide. At the center of the insulating substance 40*b*, there is arranged the resistive exothermic element 7*b* having a coil shape along the axial direction thereof, which is connected highly conductively with the aforementioned positive terminal 2*b* so that it may liberate heat when energized. The leading end 70*b* of the resistive exothermic element 7*b*, which is located at the opposite position to the positive terminal 2b, is grounded to the bottom 41b of the aforementioned protecting metal tube 4b. It should be noted here that the protecting metal tube 4b has its outer surface coated integrally with the catalyst 6b of a film shape, which is made of at least one or any combination of platinum, rhodium and palladium for effecting the oxidation reaction by means of contact with the fuel, thereby liberating heat. The catalyst 6b comprises a carrier composed of a porous body of alumina-cobalt spinel and rhodium as a transition metal supported on a porous carrier. The catalyst 6b was prepared as follows.

Alumina power of 58 wt. % having a means particle diameter of 0.1 micron and cobalt powder of 42 wt. % having a mean particle diameter of 1.0 micron were mixed; a small amount of water was added to the mixed powders, which were further mixed with each other. The obtained mixture was heated at 1350° C. for 10 hours in an electric furnace to sinter the same. Thus, a sintered spinel powder was obtained. Then, the sintered spinel powder was integrally coated on an exposed outer wall of the protecting metal tube 4b with a thickness of about 0.1 to 0.5 mm to form a coating layer composed of a porous body for a carrier. Before effecting such a coating, a molten mixture composed of copper and aluminum was sprayed on the exposed outer wall of the protecting metal tube 4b to promote adhesion of the coating layer thereon. Then, the porous body was immersed in a solution of rhodium nitrate, dried and calcined to be impregnated with rhodium. The catalyst 6b according to the third embodiment of the present invention was prepared. Thus, the ignition plug 8b of the present third embodiment has the igniting portion 9b comprising its film-shaped catalyst 6b, protecting metal tube 4b and insulating substance 40b in which the resistive exothermic element 7b is arranged. In FIG. 7, a character 100b shows a screw part of an attachment portion 3b in the base portion for attaching the ignition plug to a predetermined portion of a combustion chamber in an engine.

The operational effects of the ignition plug 8b thus constructed according to the present third embodiment will be described for the example, in which it is applied to the socalled FM type internal combustion engine having its piston formed with a cavity. The FM type internal combustion engine is called a stratified charge ignition engine. As shown in FIG. 8, more specifically, the FM type internal combustion engine has a spherical cavity 17b in the head portion of a piston 16b. As a result, the air from the not-shown intake passage is swirled into the cavity 17b, and the fuel is injected and supplied along the swirling flow from a fuel injection valve 25b which is mounted in a cylinder head 11b. On the other hand, the cavity 17b is formed with a recess 111b, in which there is received the ignition plug 8b mounted in the cylinder head 11b such that it faces the aforementioned fuel injection valve 25b. As a result, the fuel is brought, once injected into the cavity 17b, either directly or indirectly in the swirling flow into contact with the outer surface of the film-shaped catalyst 6b of the ignition plug 8b. At this time, since the ignition plug 8b has been heated to a high temperature by the heat which is liberated by the previous energization of the resistive exothermic element 7b, the aforementioned fuel is instantly evaporated and ignited. In these ways, the fuel fed to the film-shaped catalyst 6b effects its more active oxidation, when it contacts therewith, and liberates a higher calory of heat so that the maximum temperature is raised. On the surface of the catalyst 6b, the reaction is aided and promoted as long as the fuel droplets exist. With the initial ohmic heating action reaching as high as about 600° K., the surface temperature of the catalyst 6b is maintained at a sufficiently high level with a high thermal efficiency even if the resistive exothermic element 7b is deenergized immediately after that temperature is reached. As a result, the fuel in the cavity 17b can be ignited easily without fail by the aforementioned ignition plug 8b. After that, the ignition and combustion in the cavity 17b instantly propagate to the whole zone of the combustion chamber so that the complete combustion can be attained. Thus, the FM type internal combustion engine equipped with the ignition plug 8b according to the present third embodiment can attain substantially the same operational effects as those of the internal combustion engines used in the foregoing respective embodiments.

Figure 9:
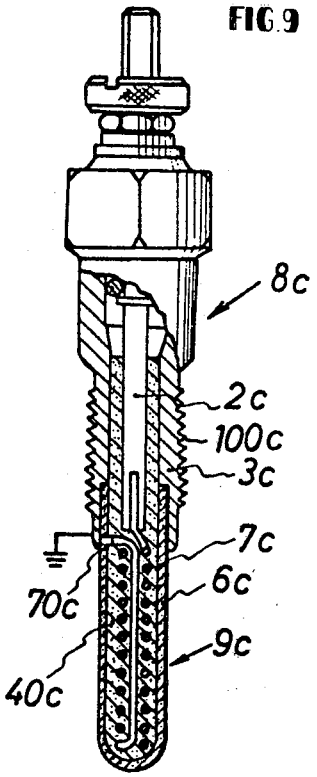

Now, the self-heating type ignition plug (SHIP) 8c according to the fourth embodiment of the present invention and the application example thereof, will be described with reference to FIGS. 9 and 10, respectively.

The difference of the ignition device 8c of the present fourth embodiment from the foregoing respective embodiments resides in that the protecting metal tube having the bottomed tubular shape is dispensed with and that the igniting portion 9c has a laminated shape composed of the insulating substance and the catalyst coating the outer surface of the insulating substance. More specifically, the insulating substance 40c and the catalyst 6c are formed into a rod shape having a preset length and having its leading end rounded. The insulating substance 40c is made of magnesium oxide. At the center of the insulating substance, there is arranged the coil-shaped resistive exothermic element 7c which is highly conductively connected with the positive terminal 2c along the axial direction thereof, thereby liberating heat when energized. The upper end 70c of the resistive exothermic element 7c opposite to the positive terminal 2c is grounded to the attachment portion 3c. Here, the insulating substance 40c has its outer surface coated integrally in a laminated form with the film-shaped catalyst 6c, which is made of at least one or any combination of platinum, rhodium and palladium, for effecting the oxidation reaction, when the fuel is brought into contact therewith, thereby liberating heat. The catalyst 6c has its one end fixed integrally to the attachment portion 3c which holds the positive terminal 2c in an insulating manner. Thus, the ignition plug 8c according to the present fourth embodiment has its catalyst 6c and insulating substance 40c constituting the igniting portion 9c. In FIG. 9, a character 100c shows a screw part of an attachment portion 3c in the base portion for attaching the ignition plug to a predetermined portion of a combustion chamber in an engine.

The operational effects of the ignition plug 8c thus constructed according to the present fourth embodiment will be described for the example, as shown in FIG. 10, in which it is applied to such a TCP internal combustion engine as is representative of the laminar combustion.

Here, the TCP internal combustion engine uses an intake valve 71 with a shroud so that an intense vortex flow 74 may be generated in a cylinder 72. At the end of the compression stroke, moreover, the fuel is injected in the forward direction along the vortex flow 74 from a fuel injection valve 75 so that it may be ignited and burned by the ignition plug 8c of the present fourth embodiment which is arranged to face the coming fuel. As a result, the resultant flame front 76 is fixed in the form of a plane having a preset line, to which the unburned mixture gases are consecutively supplied by force of the intense or strong vortex flow. In these ways, in the ignition plug 8c of the present fourth embodiment, since a high temperature has been reached by the heat which is liberated by energizing the resistive exothermic element 7c in advance, the fuel is evaporated and ignited as promptly as possible. When the fuel has been fed to the catalyst 6c, the catalyst 6c effects its more active oxidation by means of contacts with the fuel and liberates a higher calorie of heat so that the maximum temperature is raised. On the surface of the catalyst 6c, the reaction is aided and promoted as long as the fuel droplets exist. With the initial ohmic heating action reaching as high a temperature as about 600° K., the surface temperature of the catalyst 6c is maintained at a sufficiently high level with a high thermal efficiency even when the resistive exothermic element 7c is deenergized immediately after that temperature is reached. As a result, the TCP internal combustion engine thus far described can be ignited easily without fail by the aforementioned ignition plug 8c so that it can partly attain a low fuel consumption especially under a partial load condition and partly use various kinds of fuels while ensuring complete combustion. Thus, the TCP internal combustion engine according to the present fourth embodiment can attain substantially the same operational effects as those of the internal combustion engines which have been described in connection with the aforementioned respective embodiments.

Figure 11:
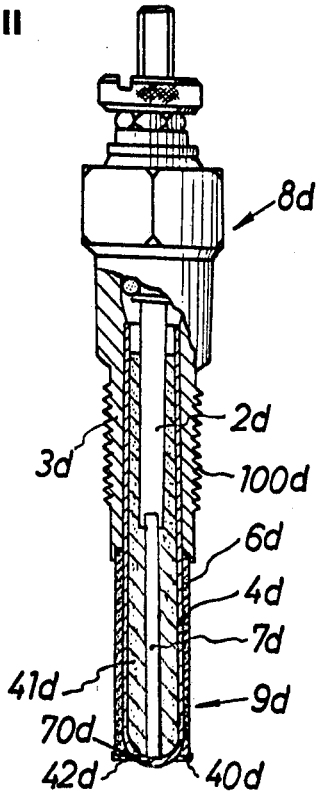
FIG. 11 is a longitudinal section showing the ignition plug according to the fifth embodiment of the present invention and the application example thereof.

Now, the self-heating type ignition plug (SHIP) 8d according to the fifth embodiment of the present invention will be described with reference to FIG. 11.

The ignition plug 8d of the present fifth embodiment is different from the foregoing embodiments in that the protecting metal tube 4d having the bottomed tubular shape is coated with the catalyst 6c and in that the catalyst 6d has its lower leading end held integrally by means of an annular metal holder 40d. In the ignition plug 8d of the present fifth embodiment, more specifically, the protecting metal tube 4d is integrally fixed to the attachment portion 3d which holds the positive terminal 2d in an insulating manner. The metal tube 4d has its inside filled up with the insulating substance 41d, such a magnesium oxide. At the center of the insulating substance 41d, there is arranged the resistive exothermic element 7d having a plate shape coaxially with the substance 41, which element is highly conductively connected with the aforementioned positive terminal 2d so that it may liberate heat when energized. The lower end 70d of the resistive exothermic element 7d opposite to positive terminal 2d is grounded to the bottom portion 42d of the aforementioned protecting metal tube 4d. It should be noted here that the annular metal holder 40d, as a stopper for contact 6d, is fixed integrally to the rounded leading end of metal tube 4d by means of welding or the like. And, metal tube 4d has its circumferential surface coated integrally with catalyst 6d having a hollow column shape, which is made of at least one or any combination of platinum, rhodium and palladium for effecting an oxidation reaction when it comes into contact with fuel, thereby liberating heat. One end of the catalyst 6d is held integrally by the aforementioned holder 40d in order to hold the catalyst. Thus, the ignition plug 8d according to the present fifth embodiment has its catalyst 6d, protecting metal tube 4d, holder 40d for the catalyst 6d and insulating substance 41d constituting together the igniting portion 9d.

The ignition plug 8d thus constructed according to the fifth embodiment can attain an increased strength and excellent shock resistance and durability in comparison with the foregoing respective embodiments, while keeping substantially the same operational effects as those of the foregoing embodiments, for the instances, in which it is applied to the internal combustion engines used with the foregoing respective embodiments.

Figure 12:
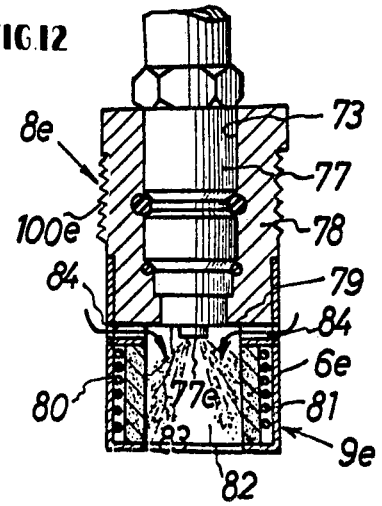

Now, the self-heating type ignition device 8e according to the sixth embodiment of the present invention and the application example thereof will be described with reference to FIGS. 12 and 13, respectively.

The ignition plug 8e according to the present sixth embodiment is made different from the foregoing embodiments in that a fuel injection valve 77 acting as the fuel supply device can be mounted integrally with the ignition plug 8e. More specifically, an attachment portion 78 is formed at its center with an attachment hole 73, in which the fuel injection valve 77 is to be mounted, and a protecting metal tube 80 having a hollow cylindrical shape is fixed integrally to the other end 79 of the attachment portion 78 so that it depends coaxially therefrom. There is mounted in the protecting metal tube 80 a coil-shaped resistive exothermic element 81 which is highly conductively connected with a (not-shown) positive terminal, while being grounded to the attachment portion 78, so that it may liberate heat when it is energized. There is further mounted in the protecting tube 80 inside of the resistive exothermic element 81 the catalyst 6e, which is of a hollow cylindrical shape having a preset thickness and which is held concentrically and integrally. As a result, in the ignition plug 8e of the present sixth embodiment, there is formed at the other end 79 a bottomed tubular recess 82 having a bottom portion 83, in which the fuel injection valve 77 has its fuel injection port 77e opened so that the fuel may be brought into contact with the aforementioned catalyst 6e to a satisfactory extent. The bottomed tubular recess 82 is formed in the circumferential wall in the vicinity of its bottom portion with a plurality of communication holes 84, through which air is introduced from the outside into the recess 82. Thus, the ignition plug 8e of the present sixth embodiment has its protecting metal tube 80 and catalyst 6e constituting the igniting portion 9e.

The operational effects of the ignition device 8e thus constructed according to the sixth embodiment will be described for the example, in which it is applied to such an internal combustion engine with an intake air preheater as can facilitate the start of the ignition device.

Turning to FIG. 13, the internal combustion engine with the intake air heater is equipped with the ignition plug 8e of the present sixth embodiment, which is arranged in the intake passage 85 for introduction of the intake air, e.g., in a wall 87 of the passage upstream of an intake valve 86. With this arrangement, the ignition plug 8e is energized and heated to a preset high temperature prior to the start of the internal combustion engine. If a preset quantity of fuel is injected and supplied into recess 82 and intake passage 85, then it is evaporated and ignited by the aforementioned catalyst as promptly as possible. After ignition and combustion, the self-igniting function is continued even when the power supply is immediately interrupted. The resultant flame propagates from the inside of recess 82 into intake passage 85 so that it can heat the intake air instantly. In the meanwhile, the fuel injected into recess 82 is sufficiently mixed with air, which is supplied from intake passage 85 through communication holes 84 into the recess 82, so that it is carried by the air flow from the inside of recess 82 into intake passage 85. As a result, combustion trouble or the like can be restrained while providing the practical effect that the running operation of the internal combustion engine can be stabilized and smoothened.

As a result, the internal combustion engine equipped with the ignition plug 8*e* of the present sixth embodiment can properly heat the intake air so that combustion by fuel injection into the cylinder can be accomplished completely by the heated intake air. Therefore, the ignition plug can partly facilitate the start of the engine and partly minimize power consumption in comparison with the prior art while keeping substantially the same operational effects as those of the foregoing respective embodiments.

Figure 14:
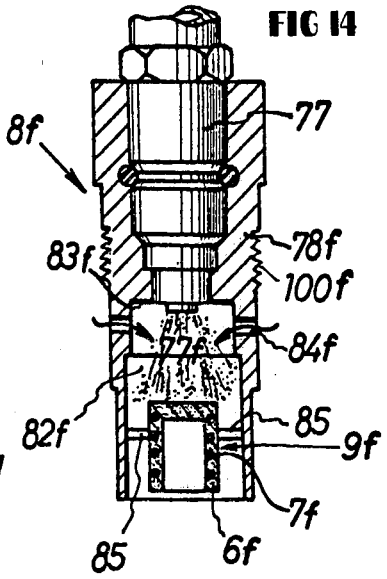
FIGS. 14 and 15 are partially sectional views respectively showing the seventh and eighth embodiments of the present invention.
Figure 15:
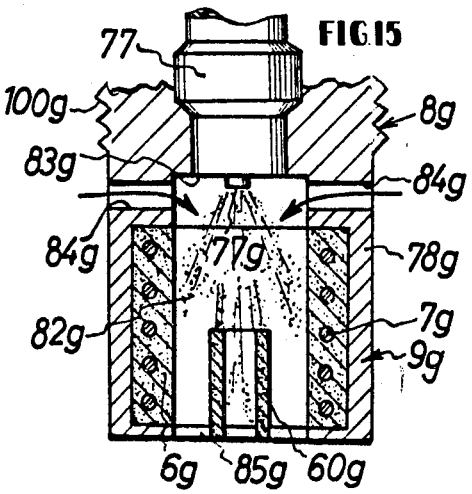

Finally, the self-heating type ignition plugs (SHIP) 8*f* and 8*g* according to the seventh and eighth embodiments of the present invention will be described with reference to FIGS. 14 and 15. Incidentally, the following description is stressed upon the differences from the aforementioned sixth embodiment, while indicating the same parts at the same numerals.

First, the ignition plug 8*f* of the seventh embodiment is different from the aforementioned sixth embodiment in that the bottomed tubular catalyst 6*f* is arranged to face the injection port 77*f* of the fuel injection valve 77. As shown in FIG. 14, more specifically, an attachment portion 78*f* is formed at its other end with a bottomed tubular recess 82*f* which has its annular bottom portion 83*f* facing the injection port 77*f* of the fuel injection valve 77. The attachment portion 78*f* is further formed in the circumferential wall thereof in the vicinity of the annular bottom portion thereof with a plurality of communication holes 84*f* which are opened into the tubular recess to introduce the air from the outside into the recess 82*f*. It should be noted in the ignition plug 8*f* of the present seventh embodiment that the bottomed tubular catalyst 6*f* is integrally fixed to the wall portion at the open side of the recess 82*f* by means of arms 85 which are coaxially mounted in a radial shape. There is mounted in the catalyst 6*f* the coil-shaped resistive exothermic element 7*f* which is highly conductively connected with the positive terminal, while being grounded to the attachment portion 78*f*, so that it may liberate heat when energized. Moreover, the catalyst 6*f* is arranged just below the fuel injection valve 77 in a manner to face the injection port 77*f* so that it can have its outer circumferential surface contacting efficiently without fail with fuel coming therefrom, thereby having an increased contact area with the fuel.

On the other hand, the ignition device 8*g* according to the eighth embodiment is made different from the foregoing respective embodiments in that the catalyst 6*g*, having a hollow cylindrical shape, is made coaxially dual and is arranged to face the injection port 77*g* of the fuel injection valve 77. As shown in FIG. 15, more specifically, the attachment portion 78*g* is formed at its other end with the bottomed tubular recess 82*g*, which has its annular bottom portion 83*g* facing the injection port 77*g* of the fuel injection valve 77. The attachment portion 78*g* is further formed with a plurality of communication holes 84*g*, which are arranged in the circumferential wall portion in the vicinity of the bottom portion thereof so that the air may be introduced therethrough from the outside into the recess 82*g*. It should be noted in the ignition plug 8*g* of the present eighth embodiment that the primary and secondary catalysts 6*g* and 60*g*, having the hollow cylindrical dual shape, are arranged coaxially at a preset spacing in between within the recess 82*g*. There is mounted in the primary catalyst 6*g* the coil-shaped resistive exothermic element 7*g* which is highly conductively connected with the (not-shown) positive terminal, while being grounded to the attachment portion 78*g*, so that it may liberate the heat when energized. On the other hand, the secondary catalyst 60*g*, having a smaller diameter, is fixed integrally to arms 85*g* which are mounted in a radial shape to the depending opening of the attachment portion 78. The primary and secondary catalysts 6*g* and 60*g* thus constructed are arranged just below the injection port 77*g* of the fuel injection valve 77 in a manner to face each other so that they can have their respective surfaces contacting efficiently without fail with the coming fuel, thereby increasing the contacting area with the fuel.

Thus, the ignition plugs 8*f* and 8*g* according to the present seventh and eighth embodiments can remarkably improve combustion when they are applied to either the internal combustion engines thus far described in connection with the sixth embodiment or an ignition system for a steady combustion apparatus, such as gas turbines, boilers, heating furnaces or room heaters. In addition the ignition plugs 8*f* and 8*g* can attain the practically excellent effects which are similar to those operational effects of the foregoing respective embodiments.

Figure 16:
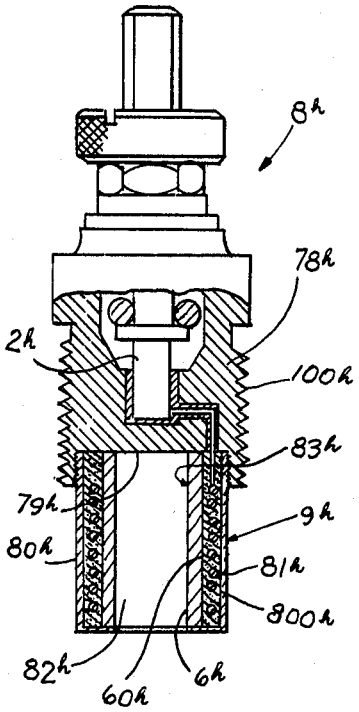
FIGS. 16 and 17 are partially sectional views respectively showing the ninth and tenth embodiments of the present invention.

Now, the description of a ninth embodiment according to the present invention will be described with reference to FIG. 16.

The ignition plug 8*e* according to the present ninth embodiment is made different from the foregoing embodiments in that a catalyst 6*h* comprises a hollow member. The catalyst 6*h* of the hollow member is integrally connected to the base portion and is provided with a coil shaped heater 81*h* at the outer wall thereof in an electrically insulated manner. Further, a protecting metal tube 80*h* of a cylindrical hollow member is coaxially and integrally connected to an attachment portion 78*h* of a hollow cylindrical shape in such a manner it depends therefrom. In the axial portion of the hollow portion in the attachment portion 78*h*, a positive terminal 2*h* is positioned in an electrically insulated manner. The coil-shaped heater 81*h* of exothermic element is highly conductively connected to the positive terminal 2*h* at one end thereof and is grounded to the protecting metal tube 80*h* at the other end thereof, so that it may liberate heat when it is energized. The coil-shaped exothermic element 81*h* is coaxially interposed between an outer wall 60*h* of the catalyst 6*h* and an inner wall 800*h* of the metal tube 80*h* in electrically insulated manner. The inner wall of the catalyst of a hollow member constitutes an ignition surface 83*h* of the ignition portion 9*h*.

The catalyst 6*h* comprises a porous carrier composed of alumina-magnesia spinel and palladium as a transition metal supported on the porous carrier. The catalyst 6*h* was prepared as follows:

Alumina powder of 74 wt.% having a mean particle diameter of 0.1 micron and magnesia powder of 26 wt.% having a mean particle diameter of 0.3 micron were mixed and a small amount of water was added to the mixture. The mixture was charged into a metal die and heated at 1350° C. for 10 hours in an electric furnace to sinter the same. Whereby, a porous body composed of alumina-magnesia spinel as a hollow-shaped carrier was obtained. Then, the porous body was immersed in a solution of palladium nitrate, dried and calcined to obtain the catalyst 6h according to the ninth embodiment of the present invention.

The above-mentioned ignition plug 8h according to the ninth embodiment of the present invention may be applied to the respective internal combustion engines set forth in the foregoing application examples. Namely, fuel is supplied into a hollow portion 82h of the hollow member of catalyst and is made to come in contact with the ignition surface 83h of the igniting portion 9h in ignition plug 8h. The catalyst 6h of the ignition plug 8h is heated by the coil-shaped heater 81h when it is energized; after it is deenergized, the catalyst 6h itself liberates heat due to the oxidation reaction effected by means of contact of the catalyst and the fuel, thereby heating the catalyst 6h of ignition plug 8h to a predetermined temperature. As a result, the fuel is ignited and burned as a whole by the ignition plug. The ignition plug 8h of this embodiment can attain the practically excellent effects which are similar to those operational effects of the foregoing respective embodiments.

Figure 17:
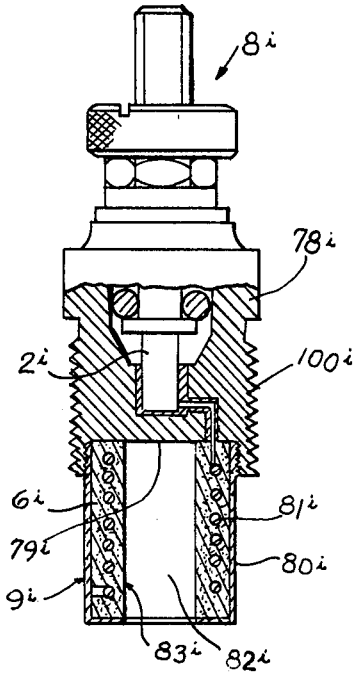

Now, the description of a tenth embodiment according to the present invention will be described with reference to FIG. 17.

The ignition plug 8i according to the tenth embodiment of the present invention is made different from the foregoing embodiments in that a catalyst 6i comprises a hollow member which is integrally connected to the base portion and is provided with a coil-shaped exothermic element 81i therein. A protecting metal tube 80i is coaxially and integrally connected to an attachment portion 78i of a hollow cylindrical shape in such a manner that it depends therefrom. In the axial portion of the hollow portion in the attachment portion 78i, a positive terminal 2i provided in an electrically insulated manner. The coil-shaped heater of exothermic element 81i is highly conductively connected to the positive terminal 2i at one end thereof and is grounded to the protecting metal tube 80i at the other end thereof. The coil-shaped exothermic element 81i is interposed within the catalyst 6i. The inner wall of the catalyst of a hollow member having a hollow portion 82i constitutes an ignition surface 83i of the igniting portion 9i.

The catalyst 6i comprises a porous carrier composed of alumina-magnesia spinel and platinum as a transition metal supported on the porous carrier.

The above-mentioned ignition plug 8i according to the tenth embodiment of the present invention may be applied to the respective internal combustion engines set forth in the foregoing application examples. The ignition plug 8i of this embodiment can attain the practically excellent effects which are similar to those operational effects of the foregoing respective embodiments.

As has been described hereinbefore, in short, the self-heating type ignition plug according the present invention comprises a resistive exothermic element for liberating heat, when energized, and a catalyst arranged in the vicinity of said resistive exothermic element and which comprises at least one transition metal, such as platinum, rhodium, palladium, nickel, iron, cobalt, chromium, tungsten, molybdenum, vanadium, mixtures thereof and oxides thereof, for effecting an oxidation reaction when it is in contact with the fuel, thereby liberating In the self-heating type ignition plug according to the present invention, the catalyst is heated to a preset temperature by instantly energizing said resistive exothermic element, and the catalyst itself effects an oxidation reaction when it comes into contact with the fuel, even after the energization of the resistive exothermic element is interrupted, to liberate heat and thus maintain a preset temperature. Thus, the self-heating type ignition plug can attain the practically significant effects that it effects the multiplication of the ohmic heating and self-heating actions so that the thermal efficiency may be remarkably improved while minimizing power consumption, that the fuel is evaporated and ignited as soon as possible so that it may be stably and smoothly burned, and that the construction is simplified to enhance the productivity and durability while reducing production cost.

If, on the other hand, the self-heating type ignition plug of the present invention is applied to a compression ignition internal combustion engine, such as a Diesel engine, the ignition is effected promptly by the aforementioned ohmic heating and self-heating actions so that the noises, which might otherwise result from ignition delay, can be prevented. Moreover, stable and smooth combustion is effected to restrain generation of white smoke, thus reducing the noxious content in engine exhaust gases together with fuel consumption. Still, moreover, a self-cleaning action for burning out soot can be effected by active oxidation. On the other hand, the ignition device of the present invention can find its most proper applications, when it is exposed to fuel, as an ignition device for a steady combustion system, such as a preheating chamber, an internal combustion engine with a vortex flow chamber, an internal combustion engine of an injection type into a cylinder or intake pipe, a gas turbine, a boiler or a heating furnace, as an ignition device for a heater, or as a preheater for intake air. Those transition elements thus added may be used solely or in any suitably selected combination.

Moreover, the present invention can adopt modes of various modifications and deformations in addition to any suitably selected combination of the aforementioned respective embodiments if it is within the scope of the claim.

What is claimed is:

1. A self-heating type ignition plug comprising a base portion having a fixing portion formed on an outer wall thereof and a terminal insulatedly provided therein and connected to an electrical source, an ignition means integrally connected to the said base portion, having an ignition surface formed on a wall surface thereof and composed of a catalyst comprising a transition metal, and a heating means comprising a resistive exothermic element connected to the terminal of said base portion, the resistive exothermic element being provided adjacent to the ignition surface within the ignition means, whereby fuel may be ignited and burned as a whole by said ignition surface of the catalyst which is maintained at preset temperature due to an oxidation reaction of said catalyst and the fuel in contact therewith, after the heating means is deenergized.

2. A self-heating type ignition plug according to claim 1, wherein said ignition means comprises a rod member and said ignition surface is formed on an outer wall of said rod member.

3. A self-heating type ignition plug according to claim 1, wherein said ignition means comprises a hollow member and said ignition surface is formed on an inner wall of said hollow member.

4. A self-heating type ignition plug according to claim 1, wherein said ignition means comprises a hollow member and said ignition surface is formed on an outer wall of said hollow member.

5. A self-heating type ignition plug according to claim 3, wherein said ignition means comprises a hollow member and said ignition surface is further formed on an outer wall of said hollow member.

6. A self-heating type ignition plug according to claim 1, wherein said transition metal of said catalyst is at least one metal selected from the group consisting of platinum, rhodium, palladium, nickel, iron, cobalt, chromium, tungsten, molybdenum, vanadium, mixtures thereof and oxides thereof.

7. A self-heating type ignition plug according to claim 6, wherein said transition metal of said catalyst is supported on a carrier composed of a porous body; and said carrier is selected from the group consisting of magnesia, silicagel, titania, zirconia, mullite, silicon nitride, cordierite, alumina-magnesia spinel, alumina-cobalt spinel and ferite of spinel structure.

8. A self-heating type ignition plug according to claim 1, wherein said heating means comprises any one of a coil type heater and plate type heater.

9. A self-heating type ignition plug according to claim 2, wherein said ignition means comprises a solid rod made of catalyst; and said heating means comprises a coil type heater coaxially interposed within said solid rod.

10. A self-heating type ignition plug according to claim 9, wherein said coil type heater of said heating means is covered with a cover means, thereby providing said coil-type heater within said solid rod and insulated from the solid rod.

11. A self-heating type ignition plug according to claim 10, wherein said solid rod comprises a catalyst comprising a porous carrier composed of alumina-magnesia spinel and platinum supported on said porous carrier.

12. A self-heating type ignition plug according to claim 10, wherein said fixing portion comprises a screw part provided at an outer wall of said base portion;

said cover means comprises a coiled thin tube made of a stainless material;

said coil-type heater is insulatedly interposed within said coiled thin tube;

said terminal is insulatedly interposed within a thin tube made of a stainless material and is connected to one end of said coil type heater; and the other end of said coil type heater is electrically connected to said base portion.

13. A self-heating type ignition plug according to claim 10, wherein said base portion is integrally fixed into an attaching hole which is provided in a predetermined wall of an internal combustion engine with a precombustion chamber and which is opened into the precombustion chamber at one end thereof, through the screw part of said fixing portion;

said rod member of said catalyst is protruded into said precombustion chamber; and said ignition surface of said ignition means is positioned within an air flow range introduced into the precombustion chamber from the main combustion chamber through a plurality of small holes and also within an injection range of fuel supplied from an injection port provided at a bottom portion of the fuel injection valve, thereby igniting and burning the fuel.

14. A self-heating type ignition plug according to claim 9, further comprising a protecting means comprising a tube member having a bottom portion and a plurality of holes on a side wall thereof and surrounding said solid rod of catalyst, said ignition surface comprising a side wall of said solid rod of catalyst which corresponds to the plurality holes of the protecting means.

15. A self-heating type ignition plug according to claim 14, wherein said solid rod comprises a catalyst comprising a sintered porous carrier composed of alumina-magnesia spinel and platinum supported on said porous carrier.

16. A self-heating type ignition plug according to claim 14, wherein said fixing portion comprises a screw part provided at an outer wall of said base portion;

said terminal is insulatedly interposed within a thin tube made of a stainless material and is connected to one end of said coil-type heater; and the other end of said coil-type heater is electrically connected to said base portion.

17. A self-heating type ignition plug according to claim 16, wherein said base portion is integrally fixed into an attaching hole which is provided in a predetermined wall of an internal combustion engine with a vortex flow chamber and which is opened into the vortex flow chamber at one end thereof, through the screw part;

said ignition means is protruded into said vortex flow chamber; and said ignition surface of said ignition means is positioned within a flow range of vortex flow tangentially introduced into said vortex flow chamber from the primary combustion chamber through a communication passage, and also within an injection range of fuel supplied from an injection port provided at a bottom portion of the fuel injection valve, thereby igniting and burning the fuel.

18. A self-heating type ignition plug according to claim 2, wherein said rod member of said ignition means comprises a rod member made of an insulating substance and a catalyst layer coated on an outer wall of said insulating rod member.

19. A self-heating type ignition plug according to claim 18, wherein said catalyst layer comprises a porous carrier composed of alumina-magnesia spinel and palladium supported on said carrier.

20. A self-heating type ignition plug according to claim 19, wherein said fixing portion comprises a screw part provided at an outer wall of said base portion;

said terminal is insulatedly interposed within a thin tube made of a stainless material and is connected to one end of said coil type heater; and the other end of said coil type heater is electrically connected to said base portion.

21. A self-heating type ignition plug according to claim 20, wherein said base portion is integrally fixed into an attaching hole which is provided in a cylinder head of a TCP (Texaco Combustion Process) type internal combustion engine and which is opened into a cylinder at one end thereof, through the screw part of said fixing portion;

said ignition surface of said ignition means is positioned within a flow range of intense vortex flow introduced into said cylinder through a shroud of the intake valve and also within an injection range of fuel supplied from an injection port of the fuel injection valve which is provided in the cylinder head opposite to said rod member, thereby igniting and burning the fuel.

22. A self-heating type ignition plug according to claim 2, wherein said rod member of said ignition means comprises a tube means interposed within said base portion, a rod member made of an insulating substance and interposed within said tube means, and a catalyst layer coated on an outer wall of said tube means.

23. A self-heating type ignition plug according to claim 22, wherein said catalyst layer comprises a sintered porous carrier composed of alumina-cobalt spinel and rhodium supported on said carrier.

24. A self-heating type ignition plug according to claim 23, wherein said fixing portion comprises a screw part provided at an outer wall of said base portion;

said terminal is insulatedly interposed within a thin tube made of a stainless material and is connected to one end of said coil type heater; and the other end of said coil type heater is electrically connected to said base portion.

25. A self-heating type ignition plug according to claim 24, wherein said base portion is integrally fixed into an attaching hole which is provided in a cylinder head of a FM type internal combustion engine and which is opened into a cavity of a piston at one end thereof, through the screw part of said fixing portion;

said rod member of said ignition means is protruded into a recess of said cavity provided within the piston reciprocally movable so as to accept said rod member therein; and said ignition surface of said ignition means is positioned within a flow range of vortex flow introduced into said cavity through an intake valve and also within an injection range of fuel supplied from the injection port of the fuel injection valve, thereby igniting and burning the fuel by means of contact of said ignition surface with said fuel.

26. A self-heating type ignition plug according to claim 22, wherein said fixing portion comprises a screw part provided at an outer wall of said base portion;

said terminal is insulatedly interposed within a thin tube made of a stainless material and is connected to one end of said coil type heater;

the other end of said coil type heater is electrically connected to said base portion; and said protecting means is connected to an annular metal holder for supporting a film-shaped rod member at an outer wall of the bottom portion thereof.

27. A self-heating type ignition plug according to claim 26, wherein said film-shaped rod member comprises a catalyst comprising a porous carrier composed of alumina-cobalt spinel and rhodium supported on said carrier.

28. A self-heating type ignition plug according to claim 3, wherein said hollow member of said ignition means comprises a hollow member made of catalyst and integrally connected to said base portion, a coil type heater insulatedly surrounding an outer wall of said hollow member of catalyst, and a tube means insulatedly surrounding said coil type heater and being integrally connected to said base portion.

29. A self-heating type ignition plug according to claim 28, wherein said hollow member comprises a catalyst comprising a sintered porous carrier composed of alumina-magnesia spinel and palladium supported on said carrier.

30. A self-heating type ignition plug according to claim 3, wherein said hollow member of said ignition means comprises a hollow member made of catalyst and integrally connected to said base portion, a coil type heater interposed within said hollow member of catalyst, and a tube means insulatedly surrounding said hollow member of catalyst and being integrally connected to said base portion.

31. A self-heating type ignition plug according to claim 30, wherein said hollow member comprises a catalyst comprising a porous carrier composed of alumina-magnesia spinel and platinum supported on said carrier.

32. A self-heating type ignition plug according to claim 28, wherein said base portion further comprises a fuel injection valve coaxially interposed within said base portion; and said tube means of said ignition means further comprises a plurality of air ports which radially penetrate a side wall of said tube means and which are provided at a portion thereof adjacent to said base portion.

33. A self-heating type ignition plug according to claim 32, wherein said base portion is integrally fixed into an attaching hole which is provided in a predetermined wall of the intake passage of an internal combustion engine with an intake air heater and which is opened into the intake passage at one end thereof, through the screw part of said fixing portion;

said hollow member of said ignition means is protruded into said intake passage;

said ignition surface of said ignition means is positioned within the passage for an intake air flow supplied into the cylinder through an intake valve;

said intake air supplied through air ports and said fuel supplied from the fuel injection valve are mixed with each other in said tubular recess of said hollow member; and said ignition surface of said hollow member is made in contact with said fuel to ignite and burn the fuel, thereby to heat said intake air flowing within said intake passage.

34. A self-heating type ignition plug according to claim 4, wherein said base portion further comprises a tubular recess projected therefrom;

said hollow member of said ignition means comprises a hollow member having a bottom portion made of catalyst and supported by said tubular recess through supporting means; and said heating means comprises a coil type heater coaxially interposed within said hollow member of catalyst.

35. A self-heating type ignition plug according to claim 34, wherein said base portion is provided with a terminal in coaxial and electrically insulated manners; and said coil type heater is connected to said terminal at one end thereof and is grounded to said base portion at the other end thereof.

36. A self-heating type ignition plug according to claim 35, wherein said fixing portion comprises a screw part provided at an outer wall of said base portion;

said terminal is insulatedly interposed within a thin tube made of a stainless material and is connected to one end of said coil type heater; and the other end of said coil type heater is electrically connected to said base portion.

37. A self-heating type ignition plug according to claim 5, wherein said base portion is provided with a terminal in coaxial and electrically insulated manners;

said base portion is provided with a tubular recess;

said ignition means comprises a first ignition means connected to an inner wall of said recess and a second ignition means of said hollow member having a smaller diameter than that of said first ignition means, which is coaxially suspended from said first ignition means;

a coil type heater is coaxially accepted within said first ignition means; and said coil type heater is connected to said terminal at one end thereof and is grounded to the base portion at the other end thereof.

38. A self-heating type ignition plug according to claim 37, wherein the fuel injection valve is coaxially provided at a bottom portion of said tubular recess of said base portion and a plurality of air ports penetrating said base portion is also provided at the bottom portion thereof;

fuel supplied from the injection port of said injection valve is mixed with air introduced from said air ports within said tubular recess of said first and second hollow members;

said ignition surface comprises said first and second hollow members which are in contact with the fuel at the inner wall and outer wall thereof.

* * * * *